US007644474B2

(12) United States Patent
Hoesel et al.

(10) Patent No.: US 7,644,474 B2
(45) Date of Patent: Jan. 12, 2010

(54) APPARATUS ON A SPINNING PREPARATION MACHINE FOR MONITORING FIBRE MATERIAL

(75) Inventors: Fritz Hoesel, Mönchengladbach (DE); Franz-Josef Minter, Mönchengladbach (DE)

(73) Assignee: Truetzschler GmbH & Co. KG, Moenchengladbach (DE)

( * ) Notice: Subject to any disclaimer, the term of this patent is extended or adjusted under 35 U.S.C. 154(b) by 706 days.

(21) Appl. No.: 11/362,388

(22) Filed: Feb. 27, 2006

(65) Prior Publication Data

US 2006/0191109 A1 Aug. 31, 2006

(30) Foreign Application Priority Data

Feb. 25, 2005 (DE) ..... 10 2005 009 157

(51) Int. Cl.
*D01G 31/00* (2006.01)

(52) U.S. Cl. ..... 19/0.21; 19/0.23; 19/65 A

(58) Field of Classification Search ..... 19/0.21, 19/0.23, 0.25, 65 A
See application file for complete search history.

(56) References Cited

U.S. PATENT DOCUMENTS

| | | | | |
|---|---|---|---|---|
| 4,549,086 | A | 10/1985 | Herzer | |
| 4,609,915 | A | 9/1986 | Erkens | |
| 5,289,381 | A | 2/1994 | Demuth et al. | |
| 5,297,316 | A | 3/1994 | Bernhardt et al. | |
| 6,499,194 | B1 * | 12/2002 | Gresser et al. | 19/239 |
| 2006/0191108 | A1 * | 8/2006 | Leinders et al. | 19/236 |

FOREIGN PATENT DOCUMENTS

| | | | |
|---|---|---|---|
| CH | 540 358 | | 1/1972 |
| DE | 33 21 261 | | 12/1984 |
| DE | 38 34 110 | A1 | 4/1990 |
| DE | 40 10 831 | | 10/1991 |
| DE | 40 28 365 | A1 | 3/1992 |
| DE | 42 31 795 | A1 | 4/1993 |
| DE | 199 41 723 | A1 | 3/2001 |
| DE | 202 02 780 | U1 | 6/2002 |
| EP | 0 072 935 | A2 | 3/1983 |
| GB | 1 034 577 | | 6/1966 |
| GB | 1 420 546 | | 1/1976 |
| GB | 1 557 167 | | 12/1979 |
| GB | 2 108 158 | A | 5/1983 |

OTHER PUBLICATIONS

Great Britain Search Report dated Jun. 22, 2006, issued in GB 0603547.1.
United Kingdom Search Report dated Jun. 21, 2006, issued in GB0603546.3.
German Search Report dated Sep. 7, 2005, issued in DE 10 2005 009 159.8.

* cited by examiner

*Primary Examiner*—Shaun R Hurley
(74) *Attorney, Agent, or Firm*—Venable LLP; Robert Kinberg; Leigh D. Thelen

(57) ABSTRACT

In an apparatus on a spinning preparation machine, for example, a flat card, roller card, draw frame or the like, for monitoring fiber material, having at least one rotating roller that delivers fiber material, and a monitoring arrangement device that detects undesirable accumulations (build-up) of fiber material and emits an electrical signal is present. To permit immediate detection of undesirable accumulations of material in a structurally simple manner, the monitoring arrangement comprises a non-contact sensor arrangement (sensor), which is capable of detecting undesirable accumulations of fiber material.

29 Claims, 6 Drawing Sheets

APPARATUS ON A SPINNING PREPARATION MACHINE FOR MONITORING FIBRE MATERIAL

CROSS REFERENCE TO RELATED APPLICATION

The present application claims priority from German Patent Application No. 10 2005 009 157.1 dated Feb. 25, 2005, the entire disclosure of which is incorporated herein by reference.

BACKGROUND OF THE INVENTION

The invention relates to an apparatus on a spinning preparation machine, for example, a flat card, roller card, draw frame or the like, for monitoring fibre material, having at least one rotating roller that delivers fibre material.

Unacceptable and undesirable piling up of material in textile machines, especially flat cards, roller cards or draw frames, can cause damage in practical operation. In the textile machinery sector, particularly in the case of flat cards and roller cards, dependent on the system the material to be processed is transferred between rotating rollers, which are mostly also fitted with clothings. Thus, for example, the fibre material is transferred from the feed to the licker-in, from the licker-in to the cylinder, from the cylinder to the doffer etc. The fibre material to be transferred, for example, cotton fibres, usually consists of a relatively thin fibre mat or fibre fleece. For this and also for other technological reasons, the paths provided for the fibre material are relatively narrow. Particularly at the transfer points, it may happen that the fibres are not passed on properly and material piles up undesirably. In these regions, problems may also arise as a result of clinging fibres, unsatisfactory suction extraction, or the like. All these malfunctions result mostly in serious problems in the machine. The risk of serious damage to individual machine elements is high whenever there is an unduly large amount of fibre material on the rollers or at the transfer points. This can ultimately lead to the cracking of covers, fixings, roller bearings, guide elements etc.

With a known apparatus (DE 32 20 636 A) on a flat card, downstream of a pair of take-off rollers there is arranged a fibre guide plate pivotable about an axis parallel to the take-off roller nip. In its working position, the fibre guide plate lies against a limit switch for stopping the machine; the limit switch is depressed. When disruptions occur during sliver formation, e.g. tearing of the sliver, fibre builds up in the region of the fibre guide plate, this is pivoted out of the vicinity of the limit switch, leading to stoppage of the machine. The disadvantage here is the structural complexity. In particular it is inconvenient that the limit switch directly detects only the position of the fibre guide plate. A build-up of fibre can only be detected indirectly. Furthermore, a response is to be initiated only when a downstream disruption, such as tearing of the sliver, occurs. Finally, it is not possible to detect and monitor the magnitude of the fibre build-up using this apparatus.

It is an aim of the invention to produce an apparatus of the kind described initially that avoids or mitigates the said disadvantages and permits direct detection of undesirable accumulations of fibre material in a structurally simple manner.

SUMMARY OF THE INVENTION

The invention provides an apparatus on a spinning preparation machine, comprising:

a rotating roller that, in use, delivers fibre material; and a monitoring device;

wherein the monitoring device comprises a non-contact sensor arrangement for detecting undesirable accumulations of fibre material.

Because the sensor arrangement is able to detect the fibre material directly, undesirable accumulations of fibre material are detectable in a direct manner. A further advantage is that the sensor arrangement operates contactlessly, whereby interference due to a mechanical device, such as a limit switch, fibre guide plate or the like, is excluded. According to the invention, undesirable piling up of material can be recognised and appropriate measures commenced. By means of appropriate responses, for example, disconnection of the corresponding drives, damage to the machines is prevented. The apparatus according to the invention can also monitor the "winding" of rollers.

Advantageously, together with a rotating or stationary counter-element the at least one rotating roller forms a gap, from which fibre material is discharged. Advantageously, the at least one rotating roller transfers the fibre material to a downstream rotating roller, or to a downstream rotating roller pair. The rotating roller may be, for example, the stripping roller of a flat card, part of a squeezing roller pair of a flat card, or part of a roller pair of a drafting system. Where it is part of a roller pair of a drafting system, the drafting system may be, for example, part of a draw frame, or of a flat card drafting system. The at least one rotating roller may be part of a cleaner or opener. Advantageously, the fibre material is discharged from a clothed roller. The fibre material may be, for example, present in the form of a fibre fleece, a fibrous web, a sliver, or a composite sliver comprising two or more slivers. Advantageously, the non-contact, for example optical, sensor arrangement is arranged outside the working path of the moving fibre material. Advantageously, the sensor is a sensor designed for optical sensing. Advantageously, the optical sensor arrangement is arranged above the working path. Advantageously, the optical sensor arrangement comprises two sensors scanning the working path. Advantageously, the optical path of the sensor is aligned in the direction of the working path of the moving fibre material. Advantageously, the sensor is a photoelectric sensor, preferably a light sensor. The sensor may advantageously be in the form of a reflex sensor. Advantageously, there is associated with the sensor a threshold value detector device, which, following a build-up of fibre material, responds to changes in the output signal of the sensor, preferably a photoreceptor of the photoelectric sensor, by emitting a build-up signal. Advantageously, the threshold value detector device signals a build-up of fibre material only when the exceeding or undershooting of its threshold value initiated by such a build-up continues uninterrupted for a predetermined duration. Advantageously, a display and/or switching device is controllable by the sensor. In machine zones at high risk, undesirable accumulations of fibre material are advantageously recognised early and hence appropriate responses are initiated to avoid damage to the machines. Preferably, recognition of fibre material accumulations is effected by means of optical sensors. Advantageously, sensors are one-way photoelectric barriers with a highly focused light beam. Advantageously, photoelectric barriers are arranged parallel to the axles of the machine-specific rollers. Advantageously, the photoelectric barriers use a laser beam as detection medium. Advantageously, light is conducted to the monitoring points by means of light guides. Advantageously, predetermined machine responses are initiated on recognition of a material accumulation. Advantageously, the responses are effected in dependence on plausibility controls. Advantageously, a response is initiated only when the light beam is interrupted for a specific time. Advantageously, the intensity of the light beam emitted by the photoelectric barrier (transmitter) is adaptable to different criteria, for example, the production or the material. Advantageously, the sensitivity of the photoelectric barrier receiver can be adapted to different criteria, for example, the production or the material. Preferably, the sensitivity and/or intensity adjustments of the photoelectric barrier for different production conditions are stored and when conditions are the same are automatically recalled and can be used without manual intervention. If desired, electronic cameras with illumination means may be used for detecting the accumulations of material. Advantageously, the optical path of the sensor runs immediately adjacent to the peripheral surface of the roller. Advantageously, the optical sensor arrangement comprises a transmitter and a receiver. Advantageously, the optical sensor arrangement is mounted in a stationary holding device. Preferably, the holding device is provided in the region laterally of the at least one rotating roller, or of the roller pair, respectively. Advantageously, the sensor arrangement is mounted on a framework or the like. The framework may be of approximately C-shaped constructions. The framework may be of approximately forked construction. The framework may be of approximately rectangular or square construction. Advantageously, the sensor monitoring arrangement for build up of fibre material and a sensor monitoring arrangement for sliver breakage are arranged on the holding device. Advantageously, sensor monitoring arrangement for sliver breakage is arranged on the holding device in the region between the shared tangents to the peripheral surfaces of the rollers. Advantageously, the optical path of the sensor monitoring arrangement runs parallel to the axle respectively axles of the rotating roller or roller pair. Preferably, a shared electrical connection is present for the sensor arrangements for monitoring material build-up and for the control device for monitoring sliver breakage. Preferably, the electrical connection for the control devices is connected to an electrical evaluation device. Advantageously, the evaluation of the electrical signals of the sensor arrangement for monitoring material build-up and of the sensor arrangement for monitoring sliver breakage is carried out separately. The electrical signals may, having regard to hardware and/or software, be processable as an aggregate signal. If preferred, the electronic signals may, having regard to hardware and/or software, be processable as a single evaluation. In one embodiment, the monitoring arrangement is used to detect undesirable winding around the rollers of a drafting system. Preferably, the rollers are the top rollers of the drafting system.

The invention also provides an apparatus on a spinning preparation machine, for example, a flat card, roller card, draw frame or the like, for monitoring fibre material, having at least one rotating roller that delivers fibre material, in which apparatus a monitoring arrangement that detects unwanted accumulations (build-up) of fibre material and emits an electrical signal is provided, characterised in that the monitoring arrangement comprises a non-contact sensor arrangement (sensor) that is capable of detecting undesirable accumulations of fibre material.

DETAILED DESCRIPTION OF CERTAIN PREFERRED EMBODIMENTS

Figure 1:
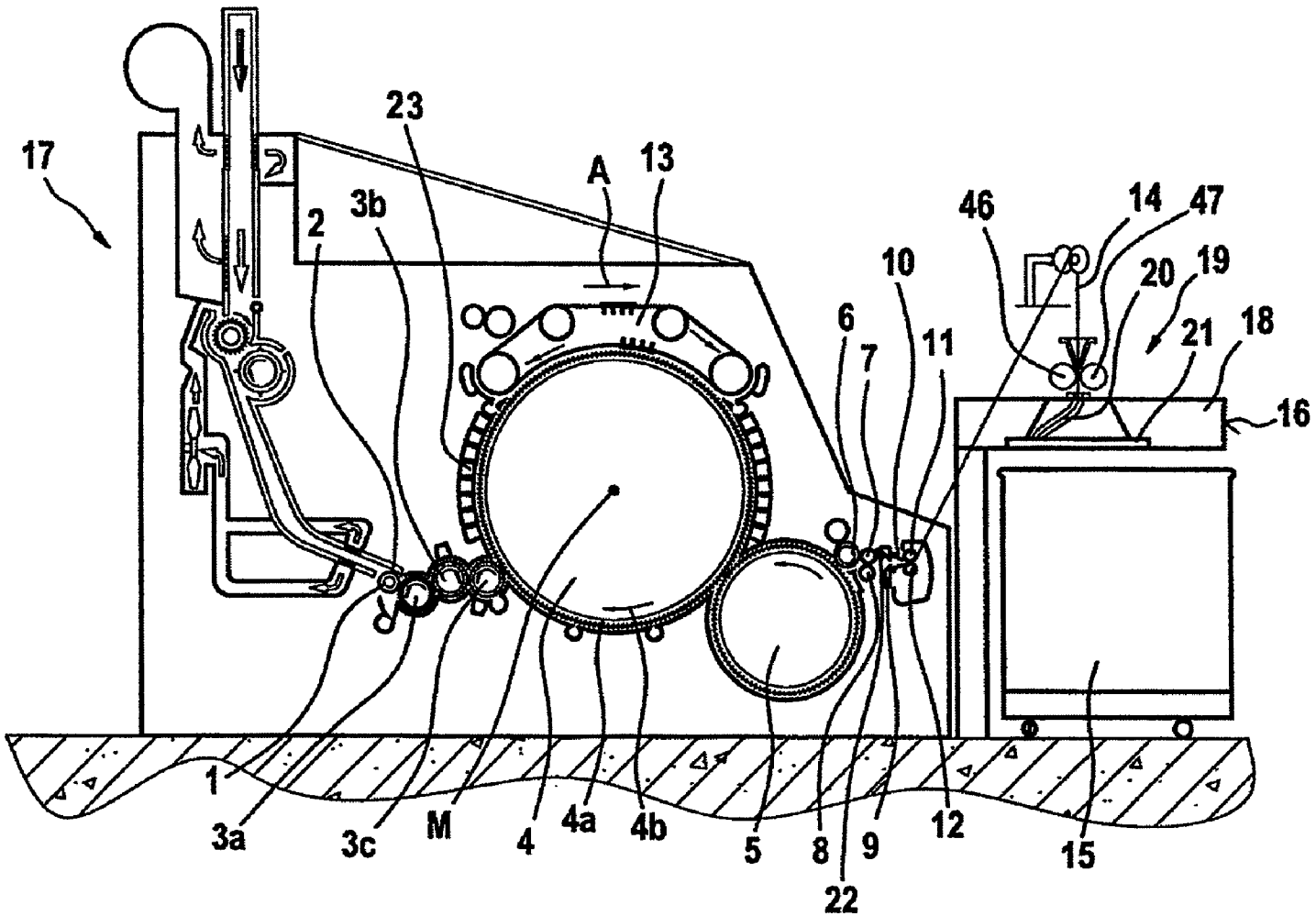
FIG. 1 is a schematic side view of a flat card with can coiler and a monitoring arrangement according to the invention for unwanted accumulations of fibre material.

With reference to FIG. 1, a card, for example, a flat card TC 03 (Trade Mark) made by Trützschler GmbH & Co. KG of Mönchengladbach, Germany has a feed roller 1, feed table 2, licker-ins 3*a*, 3*b*, 3*c*, cylinder 4, doffer 5, stripping roller 6, squeezing rollers 7, 8, web-guide element 9, web funnel 10, take-off rollers 11, 12, revolving flat 13 with flat guide rollers and flat bars, can 15 and can coiler 16. The directions of rotation of the rollers are shown by respective curved arrows. The letter M denotes the midpoint (axis) of the cylinder 4. The reference numeral 4*a* denotes the clothing and 4*b* denotes the direction of rotation of the cylinder 4. The arrow A denotes the working direction. A tuft feeder 17 is arranged upstream of the flat card. The coiling plate 19 is rotatably mounted in the delivery turntable block 18. The coiling plate 19 comprises a sliver channel 20 having an entry and an exit for the sliver, and a rotary plate 21. The reference numeral 22 denotes a photoelectric barrier that is arranged in the region between the stripping roller 6 and the squeezing rollers 7, 8 and is used to monitor undesirable accumulations of fibre material.

Figure 2:
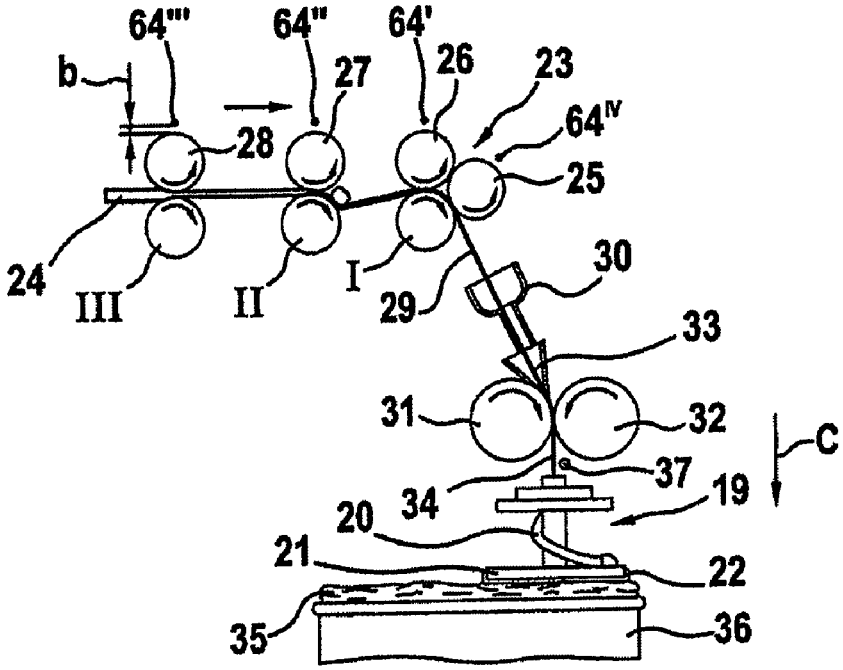
FIG. 2 is a schematic side view of the drafting system of a draw frame having a monitoring arrangement according to the invention for unwanted accumulations of fibre material.

Referring to FIG. 2, a draw frame, for example a draw frame TD 03 made by Trützschler GmbH & Co. KG, comprises a drafting system 23 having a drafting system inlet and a drafting system outlet. The slivers 24, coming from cans, not shown, enter a sliver guide and, drawn by take-off rollers, are transported past a measuring element. The drawing system 23 is designed as a 4-over-3 drafting system, that is, it consists of three bottom rollers I, II, III (I being the bottom delivery roller, II being the middle bottom roller and III being the bottom feed roller) and four top rollers 25, 26, 27, 28. Drafting of the composite sliver 24 comprising a plurality of fibre slivers takes place in the drafting system 23. The draft is made up of the preliminary draft and the main draft. The roller pairs 6/III and 5/II form the preliminary draft zone and the roller pairs 27/II and 25, 26, 27/I form the main draft zone. The drawn fibre slivers (fibre web 29) reach a web guide 30 at the drafting system outlet and are drawn by means of the take-off rollers 31, 32 through a sliver funnel 33, in which they are condensed to a fibre sliver 34, which is subsequently laid by way of a can coiler and rotary plate 21 in sliver coils 35 in a can 36. The reference number 37 denotes a photoelectric barrier, which is arranged at the outlet of the take-off rollers 31, 32 and upstream of the coiling plate 19 and serves to monitor sliver build-up.

An arrangement for monitoring winding is associated with the top rollers 25, 26, 27, 28 of the drafting system 23, a respective photoelectric barrier $\mathbf{64}^{I}$, $\mathbf{64}^{II}$, $\mathbf{64}^{III}$ and $\mathbf{64}^{IV}$ being arranged opposite the peripheral surfaces of the top rollers. Each of those barriers has a respective transmitter 64*a* and a respective receiver 64*b*. The light beam between transmitter 64*a* and receiver 64*b* is preferably highly focussed. The transmitter 64*a* and the receiver 64*b* expediently lie away from the end faces of the top rollers 25 to 28 (see FIG. 8*a*). The top rollers 25 to 28 are in practice routinely fitted with a rubber jacket, to which fibres may cling as a result of being deposited thereon and/or as a result of electrostatic charge, which lead to undesirable winding around the top rollers 25 to 28. The photoelectric barriers $\mathbf{64}^{I}$ to $\mathbf{64}^{IV}$, together with the top rollers 25 to 28, can be raised and swivelled out away from the bottom rollers I to III.

Figure 3:
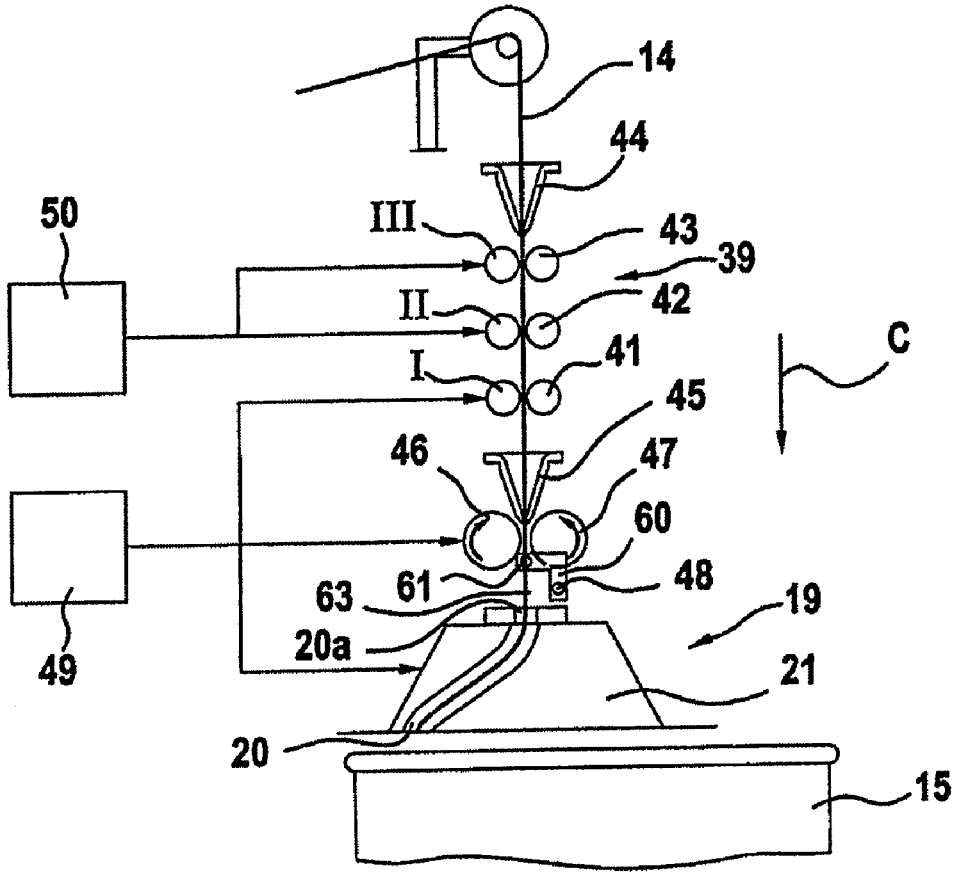
FIG. 3 is a schematic side view of a flat card drafting system having a monitoring arrangement according to the invention for sliver build-up and sliver breakage.

FIG. 3 shows an embodiment in which a flat card drafting system 39 is arranged above the coiling plate 19 between the flat card (see FIG. 1) and the coiling plate 19 (see FIG. 1). The flat card drafting system 39 is designed as a 3-over-3 drafting system, that is, it consists of three bottom rollers I, II, III and three top rollers 41, 42, 43. An input-measuring funnel 44 is arranged at the entrance to the drafting system 39 and an output-measuring funnel 45 is arranged at the output of the drafting system. Downstream of the output funnel 45 are two take-off rollers 46, 47, which rotate in the direction of the curved arrows and draw the stretched sliver 63 out of the output funnel 45. A photoelectric barrier 48 is arranged between the roller nip of the take-off rollers 46, 47 and the entry region 20*a* of the sliver channel 20, and detects undesirable sliver build-up. The bottom delivery roller I, the take-off rollers 46, 47 and the coiling plate 19 are driven by a main motor 49, the bottom feed and bottom middle roller III respectively II are driven by a variable speed motor 50. The motors 49 and 50 are connected to an electronic control and regulating device (not shown), to which all photoelectric barriers are also connected. The drafting system 23 shown in FIG. 2 is driven in an analogous manner to the flat card drafting system 39 shown in FIG. 3 (main and variable speed motors). A photoelectric barrier 61, which serves to monitor the sliver 63 for breakage (see FIGS. 8*a*, 8*b*), is arranged in the roller nip between the take-off rollers 46, 47.

Figure 4:
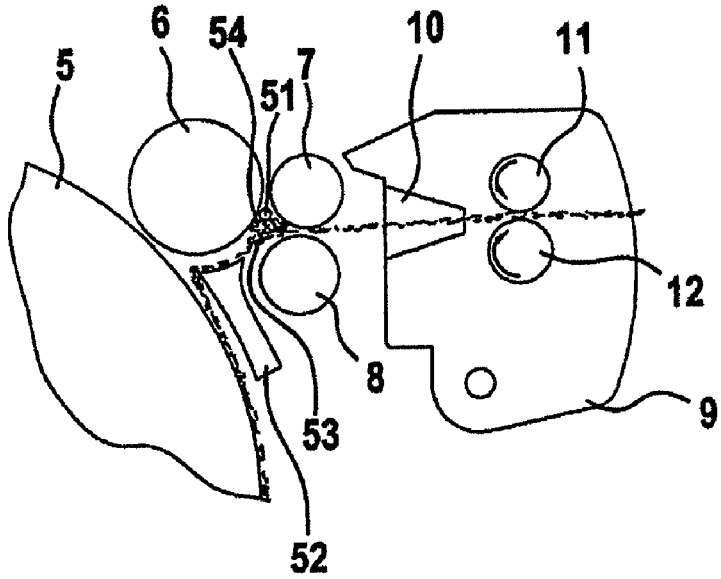
FIG. 4 shows a monitoring arrangement according to the invention in the region between stripping roller and squeezing rollers of a flat card as shown in FIG. 1, with undesirable accumulation of fibre material.

As shown in FIG. 4, in the case of a flat card (see FIG. 1) a photoelectric barrier 51 is arranged in the region between the stripping roller 6 and the squeezing rollers 7, 8. Below the stripping roller 51 there is arranged a guide element 52, over the top surface of which the fibrous web 53 detached from the stripping roller 6 slides; the web is shown running in the normal production process, illustrated schematically as a continuous line. The reference numeral 54 denotes an undesirable piling up of fibre material, which interrupts or cuts the optical path of the photoelectric barrier 51, which is arranged above the fibrous web 53 at a distance therefrom.

Figure 5A:
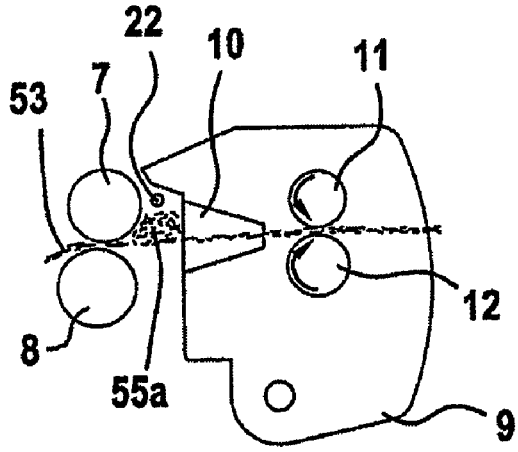
FIGS. 5*a* to 5*d* show a monitoring arrangement according to the invention in the region between the squeezing rollers and web guide element of a flat card as shown in FIG. 1, with undesirable accumulation of fibre material without fault indication (FIGS. 5*a*, 5*b*), and with fault indication (FIGS. 5*c*, 5*d*)
Figure 5B:
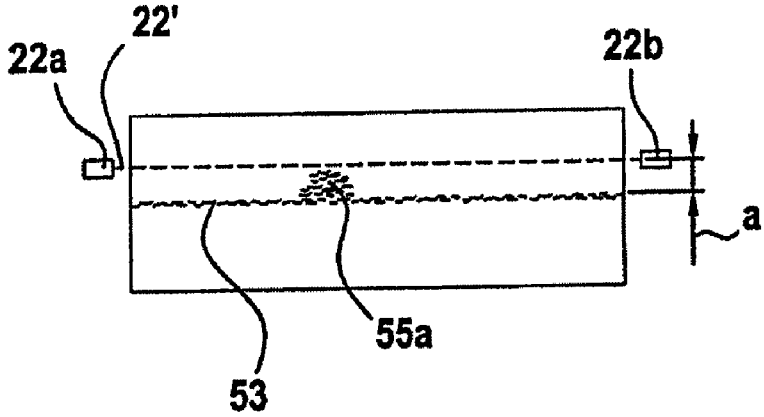
Figure 5C:
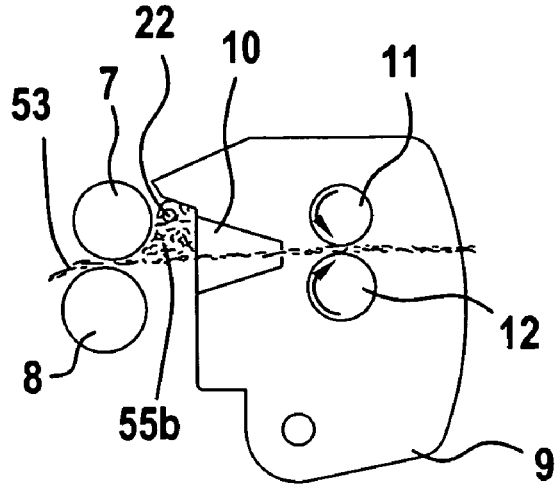
Figure 5D:
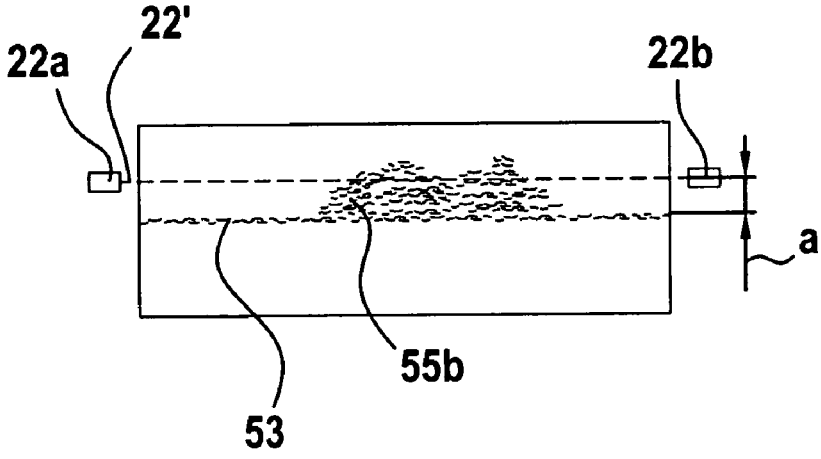

Referring to FIGS. 5*a*, 5*c*, in the case of a flat card (see FIG. 1) a photoelectric barrier 22 is provided in the region between the squeezing rollers and a web guide element 9. The photoelectric barrier 22 comprises, as shown in FIGS. 5*b*, 5*d*, a transmitter 22*a* and receiver 22*b*, between which a highly focussed light beam 22' runs. The photoelectric barrier 20 is arranged a distance a above the fibrous web 53. As shown in FIGS. 5*a*, 5*b*, an undesirable accumulation of fibre material 55*a* is present, although it extends in height below the light beam 22' and is within the distance a, so that no fault is signalled. In contrast, as shown in FIGS. 5*c*, 5*d*, an undesirable accumulation of fibre material 55*b* is present, the height of which extends beyond the light beam 22', so that the light beam 22' is interrupted and a fault is signalled.

Figure 6:
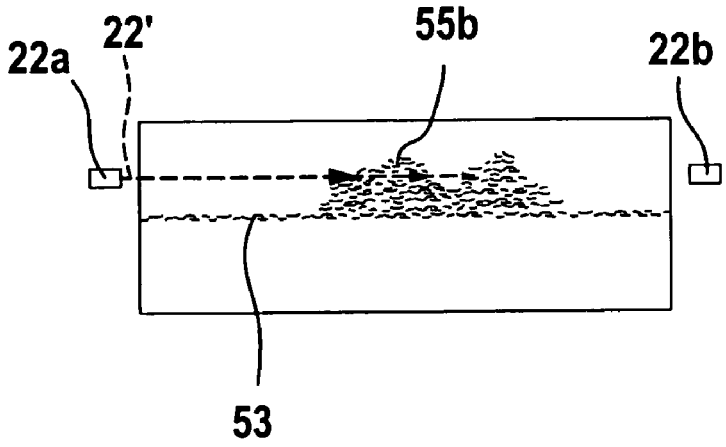
FIG. 6 shows the reduction in intensity of a light beam as a result of undesirable accumulation of fibre material.

As shown in FIG. 6, similar to the illustration in FIG. 5*d*, the accumulation of fibre material 55*b* extends beyond the light beam 22'. The intensity of the light beam 22' and the sensitivity of the receiver 22*b* are adjustable, so that light still passes through a single tuft or predetermined amounts of material, and interruption of the beam occurs only when the determinable material density is reached. Adjustment in respect of the trans-illumination of the fibre material is variable and easily changed. In this way, it is possible to determine values dependent on material or production, store these values and re-use them automatically as required.

Figure 7A:
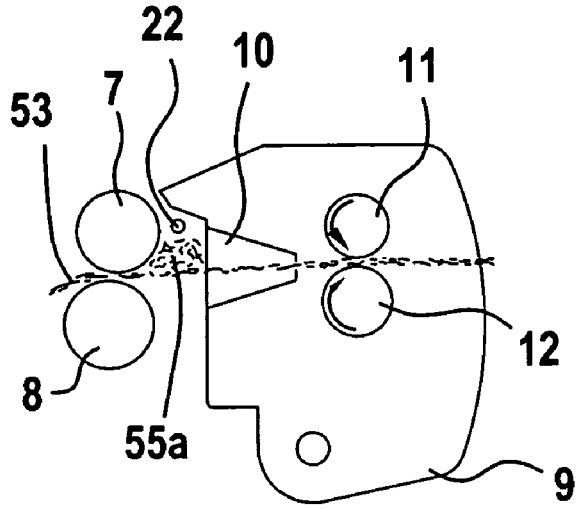
FIGS. 7*a*, 7*b* show an embodiment of a monitoring arrangement with an electronic camera in side view (FIG. 7*a*) and front view (FIG. 7*b*)
Figure 7B:
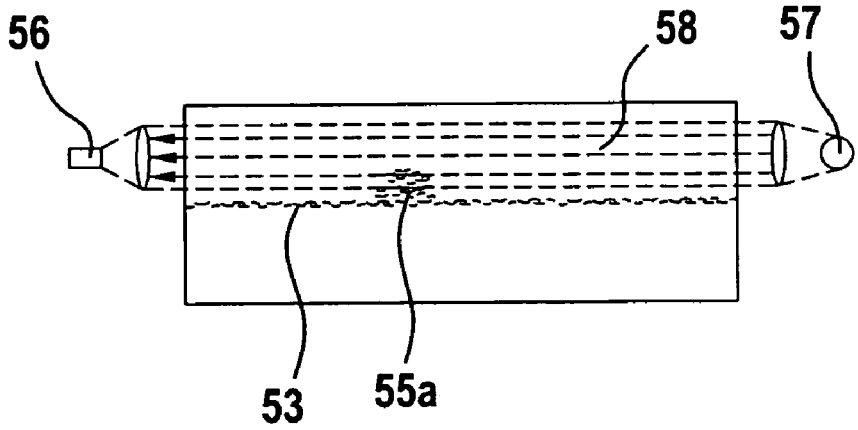

In the embodiment of FIG. 7*a*, an electronic camera 56 is arranged in the region between the squeezing rollers 7, 8 and the web guide element 9 and, as shown in FIG. 7*b*, lies opposite an illuminating device 57. The undesirable accumulation of fibre 55*a* lies in the optical region 58 between camera 56 and the illumination 57. Detection is effected by means of the electronic camera 56 and the corresponding illumination. In the case of one possible form of evaluation, the camera 56 determines the magnitude of the shadow produced by the undesirable piling up of material 53*a* and initiates appropriate responses depending thereon.

In the arrangement according to the invention, points that are especially at risk are fitted with a corresponding monitoring device. This involves, for example, photoelectric barriers, which have a very intense light beam and are mounted at a defined distance a parallel to the longitudinal axis of the relevant machine element. These photoelectric barriers are moreover arranged so that the light beam is not interrupted by the material present in normal operation but is interrupted by an inadmissible accumulation of material. Depending on the further production situation, on suitable plausibility controls and on an evaluation of all relevant information, specific drives or the entire material transport are switched off when an interruption occurs. In that case, appropriate information appears on the operator and display unit.

The use of the invention provides inter alia the following advantages:

1. Undesirable piling up of material is recognised and appropriate measures are commenced.
2. Suitable responses, for example, switching off the appropriate drives, prevent damage to the machines.
3. "Winding" of rollers can also be monitored by means of the arrangement according to the invention.

Further advantageous embodiments are, for example:

a) An interruption of the light beam is only assessed as an error when the interruption continues at least for a determined time. In this way, problem reports resulting merely from individual tufts or brief accumulations are prevented.

b) The intensity of the light beam or the sensitivity of the receiver are adjustable so that an individual tuft or specific amounts of material are still trans-illuminated and interruption of the beam is effected only when the material attains a determinable density.

c) Adjustment in respect of the trans-illumination of the material is alterable both variably and easily. In this way, it is possible to determine, for example, material-dependent or production-dependent values, store these values and re-use them again automatically as and when required.

d) The detection can also be effected by means of an electronic camera and appropriate illumination. In the case of one possible form of evaluation, the camera determines the magnitude of the shadow produced by the undesirable accumulations of material and initiates appropriate responses depending thereon.

Figure 8A:
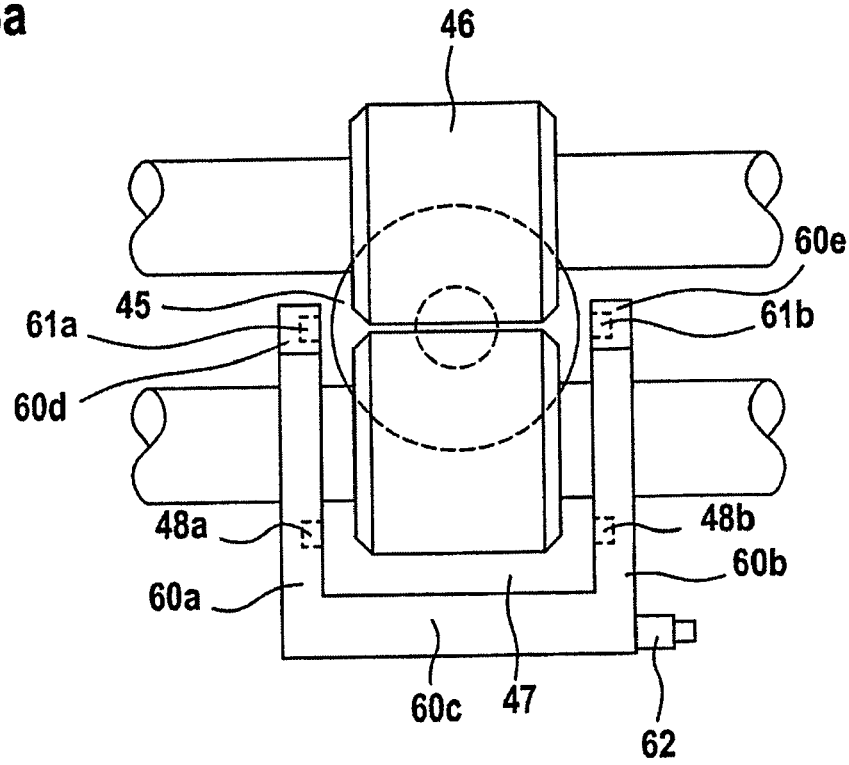
FIG. 8*a* is a front view onto a holding device having an arrangement for monitoring build-up of fibre material and an arrangement for monitoring sliver breakage at a pair of take-off rollers.
Figure 8B:
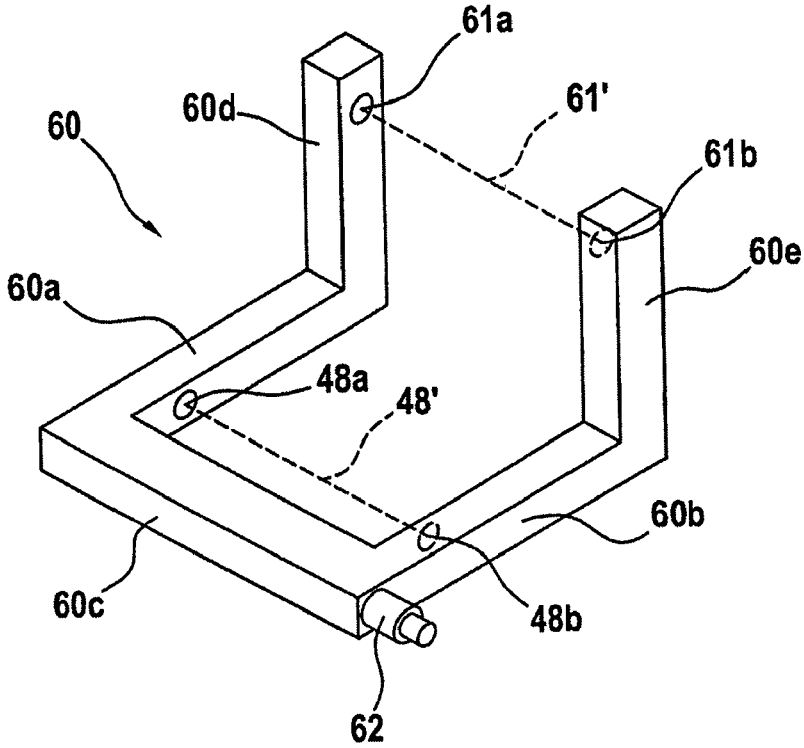
FIG. 8*b* shows a perspective view of the holding device shown in FIG. 8*a*, with electrical connection.

FIG. 8*a* is a front view onto the roller nip at the outlet of the take-off rollers 46, 47 (see FIG. 3). An approximately fork-shaped holding element 60 is associated with the region at, and upstream of, the roller nip; as shown in FIG. 8*b*, this element comprises two parallel longitudinal struts 60*a*, 60*b*, forming an open, approximately U-shaped rectangle, which at one end are joined to one another by a cross strut 60*c*. Respective extensions 60*d* and 60*e* projecting at right angles are mounted at the two other ends of the longitudinal struts 60*a*, 60*b*. A photoelectric barrier 48 is arranged between the insides of the longitudinal struts 60*a*, 60*b*, such that the transmitter 48*a* is mounted on the longitudinal strut 60*a* and the receiver 48*b* is mounted on the longitudinal strut 60*b*. The optical path between transmitter 48*a* and receiver 48*b* is marked 48'. A photoelectric barrier 61 is arranged between the insides of the extensions 60*d* and 60*e*, such that the transmitter 61*a* is mounted on the extension 60*d* and the receiver 61*b* is mounted on the extension 60*e*. The optical path between transmitter 61*a* and receiver 61*b* is marked 61'. 62 denotes a shared electrical connection for the photoelectric barriers 48 and 61. As shown in FIG. 8*a*, the holding element 60 is associated with the roller outlet of the take-off rollers 46, 47 in such a way that the optical path 61'—a highly focussed beam—extends within the roller nip (wedge-shaped region) parallel to the axles of the take-off rollers 46, 47. The photoelectric barrier 61 forms a means monitoring sliver breakage. When the light beam 61' between transmitter 61*a* and receiver 61*b* is interrupted, a sliver 63 is present (see FIG. 3). When the light beam 61' runs from the transmitter 61*a* to the receiver 61*b* without interruption, no sliver 63 is present (fault). It is advantageous for the sliver 63 to be guided in a defined manner within the roller nip (narrowing gap) and especially in the vicinity of or even at the fibre material gripping point (nip) between the two take-off rollers 46, 47, that is, there are no deviations, vibrations or the like which could cause the sliver 63 to leave the optical path 61'.

Furthermore, in relation to the roller outlet of the take-off rollers 46, 47, the holding element 60 is arranged so that the optical path 48' outside the roller nip (wedge-shaped region) runs preferably parallel to the axles of the take-off rollers 46, 47. The photoelectric barrier 48 forms a means monitoring sliver build-up. When the light beam 48' between transmitter 48*a* and receiver 48*b* runs from transmitter 48*a* to receiver 48*b* without interruption, no build-up of the sliver 63 is present (see FIG. 3). In this way, a combined optical monitoring for both sliver breakage and sliver build-up can be produced using one arrangement.

Although the foregoing invention has been described in detail by way of illustration and example for purposes of understanding, it will be obvious that changes and modifications may be practised within the scope of the appended claims.

What is claimed is:

1. An apparatus on a spinning preparation machine, comprising:

a rotating roller that, in use, delivers fibre material along a conveying path;

a rotating or stationary counter-element positioned downstream of the rotating roller to form a gap with the rotating roller downstream of the rotating roller and above the conveying path; and a monitoring device comprising a non-contact sensor arrangement arranged above the conveying path and positioned to detect an undesirable accumulation of loose fibre material in the gap.

2. An apparatus according to claim 1, wherein the monitoring device is arranged to emit an electrical signal.

3. An apparatus according to claim 1, wherein the counter-element comprises a downstream rotating roller or a downstream rotating roller pair.

4. An apparatus according to claim 1, wherein the rotating roller comprises at least one of a stripping roller of a flat card, a part of a squeezing roller pair of a flat card, or a part of a roller pair of a drafting system.

5. An apparatus according to claim 1, wherein the monitoring device further detects undesirable winding around one or more rollers of a drafting system.

6. An apparatus according to claim 5, wherein the one or more rollers comprise the top rollers of the drafting system.

7. An apparatus according to claim 5, wherein the drafting system comprises at least one of a part of a draw frame, part of a flat card drafting system, or part of a cleaner or opener.

8. An apparatus according to claim 1, wherein the rotating roller comprises a clothed roller.

9. An apparatus according to claim 1, wherein the rotating roller comprises at least one of a roller that delivers fibre material in the form of a fibre fleece, a roller that delivers fibre material in the form of a fibrous web, or a roller that delivers fibre material in the form of a sliver or in the form of a composite sliver comprising two or more slivers.

10. An apparatus according to claim 1, wherein the monitoring device comprises an optical sensor arrangement.

11. An apparatus according to claim 10, wherein the optical sensor arrangement is arranged outside a working path of the moving fibre material.

12. An apparatus according to claim 10, wherein the optical sensor arrangement is arranged above a working path of the moving fibre material.

13. An apparatus according to claim 10, wherein the optical sensor arrangement comprises two sensors scanning a working path of the moving fibre material.

14. An apparatus according to claim 10, wherein the optical sensor arrangement defines an optical path, and wherein the optical path is aligned in the direction of a working path of the moving fibre material.

15. An apparatus according to claim 10, wherein the optical sensor arrangement comprises a photoelectric sensor.

16. An apparatus according to claim 15, wherein the photoelectric sensor comprises a one-way photoelectric barrier with a laser beam as a detection medium.

17. An apparatus according to claim 1, wherein the monitoring device comprises an electronic camera having an illumination device to detect the accumulations of fibre material.

18. An apparatus according to claim 1, wherein the monitoring device comprises a reflex sensor.

19. An apparatus according to claim 1, wherein the monitoring device further includes a threshold value detector device, which, following a build-up of fibre material, responds to changes in an output signal of the monitoring device, by emitting a build-up signal, wherein predetermined machine responses are initiated on recognition of a fibre material accumulation.

20. An apparatus according to claim 19, wherein the predetermined machine responses depend on plausibility controls.

21. An apparatus according to claim 1, wherein the monitoring device includes at least one of the transmitter or receiver is adjustable for adapting the monitoring device to different criteria comprising at least one of the production or the material of the spinning preparation machine.

22. An apparatus according to claim 21, wherein the monitoring device stores adjustments for different production conditions and automatically recalls the adjustments when the production conditions are the same for use without manual intervention.

23. An apparatus according to claim 1, wherein the monitoring device comprises an optical sensor arrangement mounted in a stationary holding device that is located laterally of the rotating roller.

24. An apparatus according to claim 23, wherein the holding device includes a framework comprising a bifurcated portion.

25. An apparatus according to claim 23, further comprising a sensor monitoring arrangement for sliver breakage arranged on the holding device.

26. An apparatus according to claim 25, wherein the sensor monitoring arrangement for sliver breakage is arranged on the holding device in a region between shared tangents to the peripheral surfaces of the rotating roller.

27. An apparatus according to claim 25, wherein the sensor monitoring arrangement for sliver breakage includes an optical path that runs parallel to an axle of the rotating roller.

28. An apparatus according to claim 1, wherein the monitoring device further comprises a shared electrical connection with a control device for monitoring material build-up and sliver breakage.

29. A spinning preparation machine comprising one or more apparatus according to claim 1.

* * * * *

UNITED STATES PATENT AND TRADEMARK OFFICE

CERTIFICATE OF CORRECTION

PATENT NO. : 7,644,474 B2
APPLICATION NO. : 11/362388
DATED : January 12, 2010
INVENTOR(S) : Hoesel et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 991 days.

Signed and Sealed this

Sixteenth Day of November, 2010

David J. Kappos

David J. Kappos
*Director of the United States Patent and Trademark Office*